United States Patent [19]

Walker

[11] 4,086,178

[45] Apr. 25, 1978

[54] GLASS CLEANING FORMULATION

[75] Inventor: David Richard William Walker, Northwich, England

[73] Assignee: Rolls-Royce Motors Limited, Crewe, England

[21] Appl. No.: 580,828

[22] Filed: May 27, 1975

[30] Foreign Application Priority Data

Aug. 6, 1974 United Kingdom ..... 34529/74
Aug. 9, 1974 United Kingdom ..... 35118/74

[51] Int. Cl.[2] ..... C11D 1/24; C11D 1/83; C11D 3/24

[52] U.S. Cl. ..... 252/143; 252/142; 252/551; 252/557; 252/DIG. 10; 252/DIG. 11; 252/DIG. 14

[58] Field of Search ..... 252/551, 557, 170, 171, 252/DIG. 10, DIG. 11, DIG. 14, 153, 136, 139, 142, 143

[56] References Cited

U.S. PATENT DOCUMENTS

| | | | |
|---|---|---|---|
| 2,489,026 | 11/1949 | Gilbert | 106/13 |
| 3,137,713 | 6/1964 | Shen et al. | 260/400 |
| 3,257,407 | 6/1966 | Brace | 260/290 |
| 3,287,141 | 11/1966 | Bartz | 106/13 |
| 3,304,264 | 2/1967 | Durbin et al. | 252/153 |
| 3,309,321 | 3/1967 | McMaster | 252/153 X |
| 3,354,089 | 11/1967 | York | 252/91 |
| 3,463,735 | 8/1969 | Stonebraker et al. | 252/532 X |
| 3,651,120 | 3/1972 | Anello et al. | 260/458 |
| 3,666,478 | 5/1972 | Groh et al. | 96/114.5 |
| 3,696,042 | 10/1972 | Wright | 252/153 |
| 3,696,043 | 10/1972 | Labarge et al. | 252/153 |
| 3,787,467 | 1/1974 | Lucking et al. | 260/448.8 R |
| 3,840,481 | 10/1974 | Miller | 252/546 |
| 3,948,819 | 4/1976 | Wilde | 252/545 |

FOREIGN PATENT DOCUMENTS 1,130,822 10/1968 United Kingdom.

*Primary Examiner*—P.E. Willis, Jr.
*Attorney, Agent, or Firm*—Cushman, Darby & Cushman

[57] ABSTRACT

A glass cleaning formulation comprises a mixture of the sodium salts of sulphated alkyl phenoxy polyethoxy ethanols which are anionic in classification, citric acid and a fluorinated hydrocarbon surface active agent blended in an alcoholic base.

12 Claims, No Drawings

GLASS CLEANING FORMULATION

The present invention relates to a cleaning fluid.

According to the present invention, there is provided a cleaning fluid concentrate comprising a blend of an anionic surface active agent, an organic acid of the carboxylic classification or a phosphoric acid and a fluorinated hydrocarbon surface active agent blended in an alcoholic base.

Advantageously the anionic surface active agent can be either of the following chemical classifications (a) Di-sodium salts of half esters of sulpho-succinic acid or (b) preferably the sodium salts of sulphated alkyl phenoxy polyethoxy ethanols which are anionic in classification.

Advantageously the fluorinated hydrocarbon surface active agent is anionic or non-ionic in nature and the fluorinated hydrocarbon portion may exhibit a straight or branched chain configuration and may have terminal fluorocarbon groups at either one or both ends of the chain. Preferably the fluorocarbon groups are aliphatic and preferably these groups are per-fluorocarbon groups.

Fluorinated hydrocarbons exhibiting cationic properties with similar configuration to those previously mentioned may be used, however, experience has shown that to constitute a stable solution, only actetic, tartaric or o-phosphoric acid should be used.

Advantageously, the organic acid should be preferably of the carboxylic classification and should be more specifically citric acid or one of its salts - sodium citrate. In the initial cleaning evaluation to obtain effective formulations, the surface tension changes of surface active agent solutions in the presence of citrate ions was studied, and it was observed that a gradual decrease in surface tensions took place, with certain anionic surfactants, as the concentration of citrate increased.

In a preferred embodiment of the invention, the surface active agent is an anionic sulphated alkyl phenoxy polyethoxyethanol, and the blend is within the range of 3.5:1 to 13.7:1 parts by weight of the surface active agent to the fluorinated hydrocarbon surface active agent, the preferred ratio being 8.125:1.

The ratio (parts by weight) of citric acid (crystals-monohydrate) to the blend is advantageously 1.0:3.365.

A suitable dilution of the concentrate fluid is, for winter, one part by volume of the fluid to 37.8 parts by volume of water and for summer, one part by volume of the concentrate fluid to 64.5 parts by volume of water. A preferred surface tension range and pH value range of the fluid is 20–25 dynes/cm and 3.0–4.0 respectively.

Where the fluid is to be used in freezing conditions, the water used to dilute the concentrate fluid may be replaced in part by iso-propyl alcohol to impart anti-freeze properties.

In order that the invention may be more clearly understood, several embodiments of the invention will now be described by way of example. All the examples described below are of fluids suitable for cleaning vehicle windscreens or vehicle lamp glasses.

EXAMPLES 1, 2, 3 and 4

Standardweights of given surfactants and citric acid were blended with each of four differing types of Fluorinated Hydrocarbon surface active agents to produce eight concentrates which were subsequently evaluated for cleaning properties.

In these four preferred embodiments, 219 parts by weight of an anionic sulphated alkyl phenoxy polyethoxy ethanol were blended with each of the following Fluorinated Hydrocarbon surface active agents in a ratio of 8.125 : 1.0 parts by weight.

1. Anionic fluorinated hydrocarbon surface active agent with the fluorinated hydrocarbon portion exhibiting a branched chain structure and having aliphatic per-fluorocarbon groups at one end of the molecule, for example that presently marketed by I.C.I. Ltd. under their registered trade mark Monflor 31, which is the sodium salt of a branched-chain perfluoroalkyenyl oxybenzene sulphonic acid having the formula: $C_{10}F_{19}OC_6H_4SO_3{}^{\ominus}Na^{\oplus}$.
2. Non-ionic fluorinated hydrocarbon surface active agent with the fluorinated hydrocarbon portion exhibiting a branched chain structure and having aliphatic per-fluorocarbon groups at both ends of the chain such as $R_f(OCH_2CH_2)_n OR_f$
   Where $R_f$ is $C_8F_{15}$, $C_{10}F_{19}$, $C_{12}F_{23}$ and $n$ is 10 to 30.
3. Non-ionic fluorinated hydrocarbon surface active agent with the fluorinated hydrocarbon portion exhibiting a branched chain structure and having aliphatic per-fluorocarbon groups at one end of the chain such as $R_f(OCH_2CH_2)_m OR$
   R = lower alkyl preferably $CH_3$, $m$ is from 2 to 20.
4. Anionic fluorinated hydrocarbon surface active agent with the fluorinated hydrocarbon portion exhibiting a straight chain structure and having aliphatic per-fluorocarbon groups at the end of the chain for example, that sold by 3M's Company under designation FC 128 which is the potassium salt of a fluorinated alkyl carboxylate.

To each of these solutions, 237.5 parts by weight of citric acid solution, together with 593.6 parts by weight of isopropyl alcohol containing up to 11% Ethyl Hexanol were added. The resultant four concentrates were each evaluated at dilutions of 1 part concentrate plus 37.8 parts of water and 1 part concentrate plus 64.5 parts by volume of water and were all found in tests on automobile to (a) clean well (b) not to exhibit any hazing effects during night driving and (c) not to have an deleterious effect upon the surrounding rubber or paintwork.

EXAMPLES 5, 6, 7 and 8

In these four preferred embodiments, 219 parts by weight of an anionic di-sodium salt of half ester of sulphosuccinic acid were blended with each of the previously mentioned fluorinated hydrocarbon surface active agents in the ratio of 8.125 : 1 parts by weight. To each of these solutions, 237.5 parts by weight of citric acid solution, together with 593.6 parts by weight of iso-propyl alcohol containing up to 11% ethyl hexanol were added to produce four concentrates which when diluted as in examples 1–4 were evaluated for cleaning. The solutions were again in automobile tests found (a) to clean well, (b) not to exhibit any hazing effects during night driving and (c) not to have any deleterious effect upon the surrounding rubber or paintwork.

In each case for examples 1–8 the concentrate exhibited a surface tension of 23.7 dynes/cm and a pH of 3.2 (the term pH undertakes the usual meaning). When diluted the pH rises to within the range 3.6–3.8 and the surface tension drops to between 21.0–22.5 dynes/cm according to the dilution.

EXAMPLES 9 - 16

One part by volume of each concentrate produced in examples 1–8 was added to 29.24 parts by volume of water and 8.56 parts by volume of iso-propyl alcohol to produce eight working solutions for use during freezing conditions. The solutions were all evaluated during the winter months and were found in automobile tests to (a) clean well, (b) not to exhibit any windscreen hazing effects during night driving and (c) not to have any deleterious effect upon the surrounding rubber or paintwork.

In each case the working solution exhibited the following properties:

| | | |
|---|---|---|
| Appearance | - | opalescent |
| Surface Tension | - | 24.2 dynes/cm |
| pH value | - | 3.6 - 3.8 |

Because of the high degree of success encountered using the anionic hydrocarbon surfactant, citrate and fluorinated hydrocarbon surfactant formulations for glass cleaning, a decision was made to evaluate further acids within the carboxylic classification, and also to evaluate the addition of ortho-phosphoric acid. The results yielded were not as good as those of the previously described embodiments.

For each of the embodiments previously described in examples 1–8 inclusive, the citric acid was directly replaced with each of the following acids in turn, in both quantity and normality. The acids used for the replacement experiments were:

| | | |
|---|---|---|
| Formulation Nos. | 17 - 24 inclusive | Tartaric Acid |
| | 25 - 32 inclusive | Acetic Acid |
| | 33 - 40 inclusive | Ortho-phosphoic |

In all cases with these formulations certain undesirable properties were encountered. Particularly, in the case of tartaric acid where there was a solution stability problem. This was also encountered, but to a lesser extent, with the acetic acid. No stability problems were encountered using the ortho-phosphoric acid, however, paint staining took place in combination with certain of the fluorinated hydrocarbons.

As a direct result of testing the formulations as described in examples Nos. 1–40 it was found that the formulations best satisfying the parameters of (a) successful glass cleaning, (b) good solution stability with no propensity to attack rubber seals or surrounding paintwork and (c) non production of smear and haze under night driving conditions, were those applying to the citric acid containing formulations.

What is claimed is:

1. A stable glass cleaning fluid concentrate which, when diluted, does not attack rubber seals and surrounding paint while, in use, and is devoid of smearing and hazing of automobile windshields under night driving conditions, said concentrate consisting essentially of:

(a) an anionic surface active agent selected from the group consisting of:
  (i) an anionic sulphated alkyl phenoxy polyethoxy ethanol; and
  (ii) an anionic di-sodium salt of the half ester of sulphosuccinic acid;

(b) a fluorinated hydrocarbon surface active agent selected from the group consisting of:
  (i) an anionic fluorinated hydrocarbon surface active agent with the fluorinated hydrocarbon portion having a branched chain structure with aliphatic per-fluorocarbon groups at one end of the molecule;
  (ii) a non-ionic fluorinated hydrocarbon surface active agent with the fluorinated hydrocarbon portion exhibiting a branched structure and represented by the formula:

$$R_f(OCH_2CH_2)_n OR_f$$

wherein $R_f$ is $C_8F_{15}$, $C_{10}F_{19}$ or $C_{12}F_{23}$ and $n$ is 10–30;
  (iii) a non-ionic fluorinated hydrocarbon with a branched fluorinated hydrocarbon portion having the formula:

$$R_f(OCH_2CH_2)_m OR$$

wherein R is lower alkyl and $m$ is 2–20; and
  (iv) an anionic fluorinated hydrocarbon surface active agent wherein the fluoronated hydrocarbon portion exhibits a straight chain structure and has aliphatic per-fluorocarbon groups at one end of the chain;

(c) citric acid or sodium citrate (d) components (a), (b) and (c) blended together in an alcohol carrier wherein the proportion, in parts by weight, of (a) to (b) is in the ratio of 3.5:1 to 13.7:1 and the ratio, in parts by weight, of component (c) to the over-all blend is about 1:3.365, the cleaning fluid concentrate having a surface tension range of about 20–25 dynes/cm and a pH of about 3.0–4.0.

2. The glass cleaning fluid concentrate of claim 1 wherein the anionic surface active agent is an anionic sulphated alkyl phenoxy polyethoxy ethanol.

3. The glass cleaning fluid concentrate of claim 1 wherein the anionic surface active agent is an anionic di-sodium salt of the half ester of sulphosuccinic acid.

4. The glass cleaning concentrate of claim 1 wherein the fluorinated hydrocarbon surface active agent is an anionic fluorinated hydrocarbon surface active agent with the fluorinated hydrocarbon portion having a branched chain structure with aliphatic per-fluorocarbon groups at one end of the molecule.

5. The glass cleaning concentrate of claim 1 wherein the fluorinated hydrocarbon surface active agent is a non-ionic fluorinated hydrocarbon surface active agent with the fluorinated hydrocarbon portion exhibiting a branched structure and represented by the formula:

$$R_f(OCH_2CH_2)_n OR_f$$

wherein $R_f$ is $C_8F_{15}$, $C_{10}F_{19}$ or $C_{12}F_{23}$ and $n$ is 10–30.

6. The glass cleaning concentrate of claim 1 wherein the fluorinated hydrocarbon surface active agent is a non-ionic fluorinated hydrocarbon surface active agent with a branched fluorinated hydrocarbon portion having the formula:

$$R_f(OCH_2CH_2)_m OR$$

wherein R is lower alkyl and $m$ is 2–20.

7. The glass cleaning concentrate of claim 1 wherein the fluorinated hydrocarbon surface active agent is an anionic fluorinated hydrocarbon surface active agent wherein the fluorinated hydrocarbon portion exhibits a straight chain structure and has aliphatic per-fluorocarbon groups at one end of the chain.

8. The glass cleaning fluid concentrate of claim 1 wherein component (c) is citric acid.

9. The glass cleaning fluid concentrate of claim 1 wherein component (c) is sodium citrate.

10. The glass cleaning fluid concentrate of claim 1 wherein the alcohol carrier (d) is isoproyl alcohol.

11. The glass cleaning fluid concentrate of claim 1 wherein the proportion, in parts by weight, of (a) to (b) is in a ratio of about 8.125:1.

12. The glass cleaning fluid concentrate of claim 1 wherein the alcohol carrier (d) includes isopropyl alcohol and ethyl hexanol.

* * * * *